United States Patent [19]

Chen-Yuan

[11] 4,232,408

[45] Nov. 11, 1980

[54] TWO VARIABLE FLUSH GATE FOR LAVATORY RESERVOIR

[76] Inventor: Lee Chen-Yuan, No. 14 Alley 6 Lane 251 Fu-Te Street, Taipei, Taiwan

[21] Appl. No.: 25,547

[22] Filed: Mar. 30, 1979

[51] Int. Cl.[3] ..... E03D 1/14; E03D 1/34

[52] U.S. Cl. ..... 4/325; 4/382; 4/384; 4/393

[58] Field of Search ..... 4/324–326, 4/378, 379, 381, 382, 392, 393, 394, DIG. 1, 327, 345, 346, 384–386, 390, 391, 397, 405, 415

[56] References Cited

U.S. PATENT DOCUMENTS

| | | | |
|---|---|---|---|
| 524,176 | 8/1894 | Liming | 4/394 |
| 619,427 | 2/1899 | Miller | 4/381 X |
| 761,758 | 6/1904 | Burr | 4/381 |
| 1,397,208 | 11/1921 | Griffiths | 4/382 |
| 1,457,018 | 5/1923 | Carson | 4/381 |
| 2,819,471 | 1/1958 | Ezzell | 4/382 |

*Primary Examiner*—Stuart S. Levy
*Attorney, Agent, or Firm*—Blair, Brown, & Kreten

[57] ABSTRACT

Disclosed herein is a two variable flush gate for a flush toilet. It is a structure that, by means of adding and altering parts of elements in a traditional flush gate, can select a discharge quantity with simple operation of the discharge lever as needed so that unnecessary water consumption can be avoided.

5 Claims, 4 Drawing Figures

TWO VARIABLE FLUSH GATE FOR LAVATORY RESERVOIR

BACKGROUND OF THE INVENTION

Flush toilets are a necessary sanitary facility for every family and every building. Traditional flush toilets discharge all the water in its reservoir when it is used. However, the quantity of water discharged will be beyond the need for cleaning a flush toilet containing only urine, resulting in a considerable waste of water, especially in a city with a large population.

SUMMARY OF THE INVENTION

The invention is of simple construction and comprises equipment which can be operated easily. Appropriate water discharge quantities can be simply controlled by the degree the discharge lever is pressed which is controlled upon one's judgement so that the user may leave immediately after the discharge lever is pressed.

In the invention, two discharge quantity control pieces are controlled by high and low positions of floats respectively. Then, the control pieces will control the degree and time of opening of a discharge cover, which decides the quantity of water to be discharged. One can select the desired discharge quantity easily. The two floats and two control pieces work independently and accurately without mutual interference. The most significant characteristic of the invention is, in selecting a small discharge quantity, no large water discharge will occur due to excessive pushing, as would normally occur.

DETAILED DESCRIPTION OF PREFERRED EMBODIMENT

Figure 1:
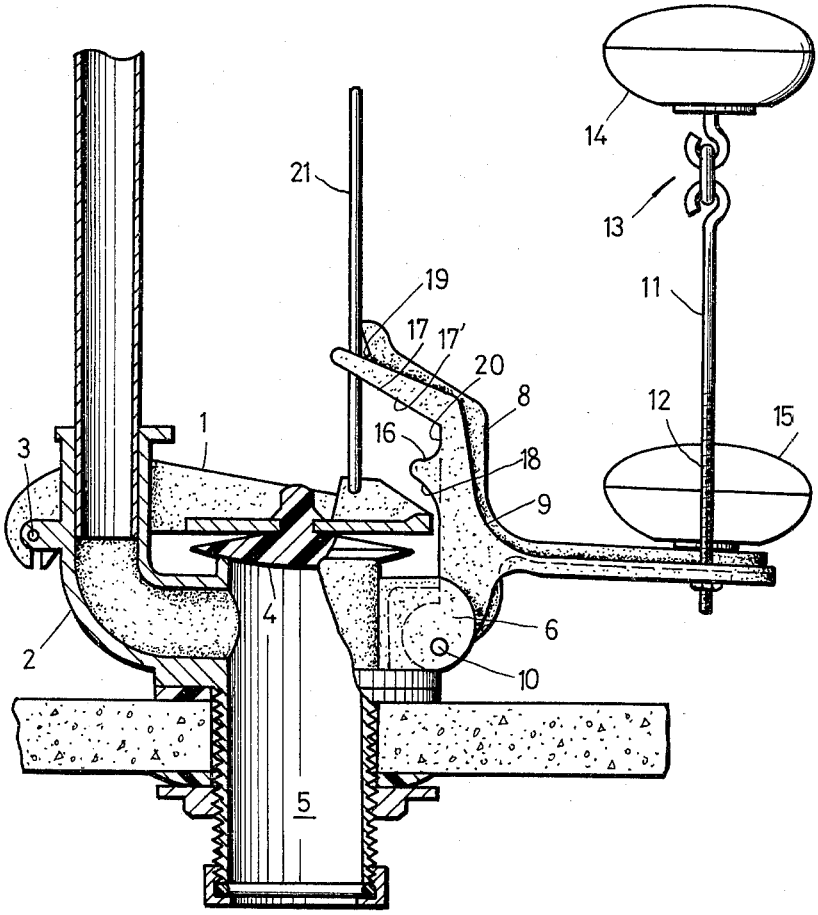
FIG. 1 is a sectional view which shows the device in a nondischarge state and displays the two control pieces and two floats, which are different from an ordinary flush gate. Other parts remain the same as an ordinary flush gate.

The following description is given with reference to the attached drawings. As indicated by FIG. 1, a discharge cover 1 is hinged at a pivot 3 on overflow pipe 2. Discharge rubber seal 4 is placed beneath discharge cover 1. The abovementioned elements are included in the main body—flush gate 5, the function and structure of which are similar to that of traditional ones and thus, a further description is not given here.

Figure 2:
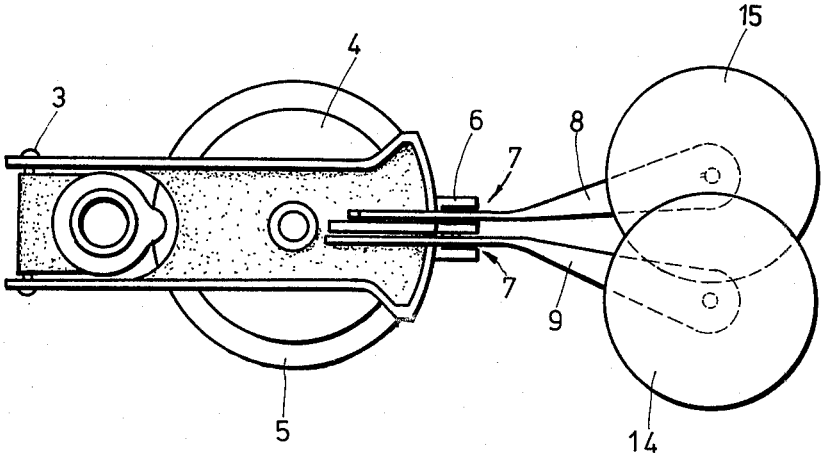
FIG. 2 is a top view of FIG. 1. It shows positions of the two floats and that no interference exists in the action of the floats and control pieces.

There are two narrow gaps 7 on the right side projection 6 of flush gate 5 (refer to FIG. 2). Within the gaps there is a control piece 8 for a larger discharge quantity and a control piece 9 for smaller discharge quantity, both of which are fixed by a pin 10 and are freely turnable. At the tail of said control piece 9 for smaller discharge quantities is screwed a tiny rod 11. A lower end of the tiny rod is threaded therewith by thread 12. Its upper end is connected with a float 14 for small discharge quantities by means of a ring 13. By turning tiny rod 11, the vertical position of float 14 for small discharge quantity is adjusted for the purpose of providing water required for cleaning urine (since the water level in the resevoir is constant). In the same manner, the tail of control piece 8 for a large discharge quantity is connected with a float 15 for the larger discharge quantity at a lower level for the purpose of providing water required for flushing feces.

On the said control piece 9 for small discharge quantities, there is a protuberant control stop 16 for small discharge quantities. When rope 21 is pulled, discharge cover 1 is opened and held by the control stop 16 for a small discharge quantity (refer to FIG. 3), the water in the reservoir is discharged from the space between discharge rubber seal 4 and the flush gate 5. Simultaneously, since the control piece 9 for a small discharge quantity responds to the floating action of float 14, and the control piece 9 keeps falling towards the discharge cover 1 till the water level reaches a predetermined level. Float 14 and its control piece 9 for a small discharge quantity are lowered following the falling of the water level till the control stop 16 for small discharge quantity is away from the discharge cover 1. Then, due to the gravity of water, the discharge cover seals the discharge port and returns to its original position. Of course, the supply of water to the reservoir commences after discharge is started. Water supply to the reservoir will stop after the water reaches the predetermined level. Supply of water is made in a way identical to that of an ordinary reservoir, the description for which is thus omitted.

Figure 3:
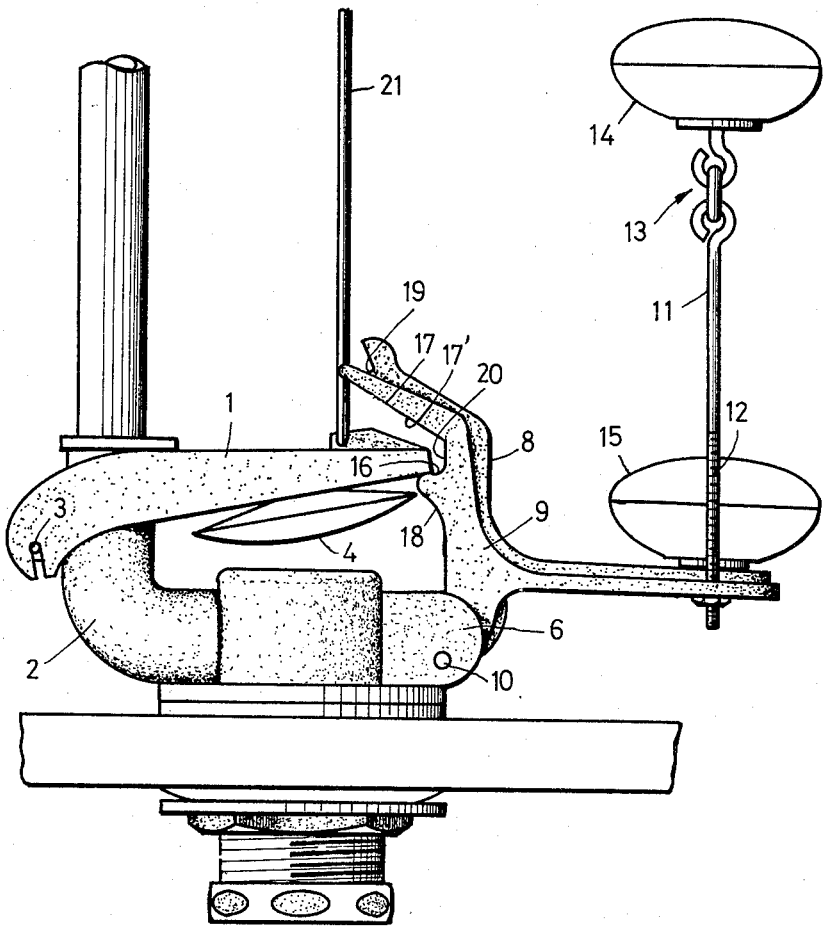
FIG. 3 is a front view of the invention which shows actuation of the flush gate during the small discharge quantity mode. It illustrates that the discharge cover is held by the control piece and the falling of the discharge cover is controlled by the float for small discharge quantities.

As shown in FIG. 1 and FIG. 3, there is a sensing edge 17 on the top of control stop 16 for small discharge quantity. The said sensing edge is approximately horizontal. Since the lower part of control stop 16 for a small discharge quantity is a cam like surface 18 a small discharge quantity is easily emitted. After the cover 1 has passed control stop 16, since sensing edge 17 has a small declination, a more powerful force is required for further pulling up discharge cover 1. Therefore, from the clear difference in pulling forces, one can cause discharge cover 1 to be kept on the control stop 16 for a small discharge quantity.

There is a vertical wall portion 20 between the control stop 16 for a small discharge quantity and the sensing edge 17 so that the end of the discharge cover will free in order to make a clear distinction between the two modes.

Figure 4:
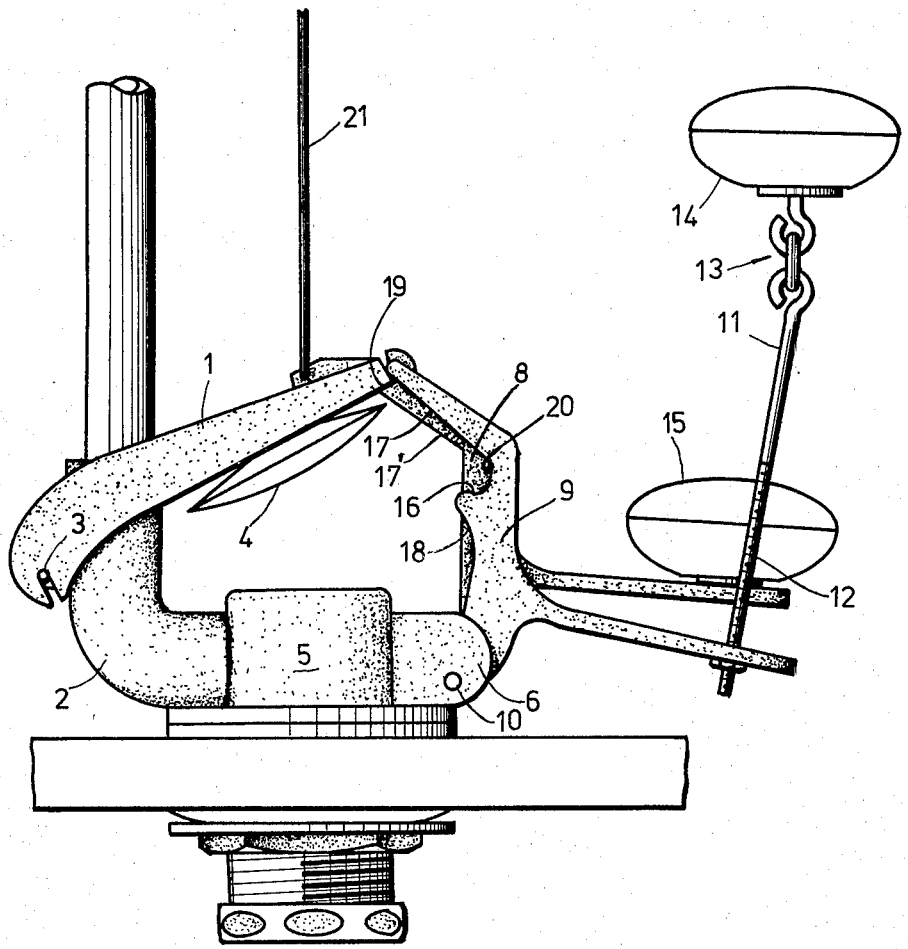
FIG. 4 is a front view of the invention which shows actuation of the flush gate during the large discharge quantity mode. It illustrates that the discharge cover is held by the control piece for a large discharge quantity and its falling is controlled by the float for a large discharge quantity.

As shown in FIG. 1 and FIG. 4, the control piece 8 for a large discharge quantity has a like sensing edge 17 whose function is identical to the sensing edge 17 of control piece 9 for a small discharge quantity. On the top of the control piece 8 for large discharge quantity there is a control stop 19 for the larger discharge quantity. Such a control stop 19 is designed for more water discharge which is required in flushing of feces. Mode of operation: Discharge cover 1 is pulled past camming jaw 18, and a bigger force is applied so that it will pass sensing edges 17 and 17' and its then held by the control stop 19 for the large discharge quantity. Then, by the floating action of float 15, control stop 19 of the control piece 8 will hold discharge cover 1 until the water level falls to the predetermined level. After the water level passes the predetermined level, float 15 falls gradually. Finally, control stop 19 is moved away from the discharge cover 1 so that the discharge cover falls down and seals the discharge port. Supply of water into the reservoir commences as soon as the water is discharged until the water content reaches its maximum.

As shown in FIG. 1, control piece 8 for the large discharge quantity and the control piece 9 for the small discharge quantity contact the projection 6 during normal operation and prior to discharge of the water. They do not contact the terminal of discharge cover 1, since if there were contact the floating force of floats 14 and 15 will cause control pieces 8 and 9 to push discharge cover 1 at its terminal resulting in discharge cover 1 not being opened easily during the discharge condition.

In conclusion, the invention uses an additional control piece and changes the shape of control pieces. It controls the discharge quantity by means of two floats at different heights. It is compatible with existing equipment and saves water consumption. Operation of the invention is simple and the steps are clearly defined in actual operation.

I claim:

1. A flush gate for a toilet flush tank having two modes of actuation for permitting two different water volumes to be selectively flushed, comprising, in combination:

a pivot area, a first control piece pivoted at said pivot area to a flush gate housing having first and second extremities on opposed sides of said pivot area, a flush gate seal pivotably mounted on said flush gate housing, means on said first extremity to engage and retain said flush gate seal overlying said flush gate for one time interval first float means on said second extremity to disengage said seal from said first extremity when the water volume falls to a selected level;

a second control piece pivoted at said pivot area and laterally spaced from said first control piece, and substantially parallel thereto having first and second extremities on opposed sides of said pivot area with means on said first extremity to engage and retain said seal for a second time interval, and second float means on said second extremity to disengage said seal when the water volume falls to another selected level, said first and second control pieces being pivoted in said pivot area about a single pivot axis.

2. The device of claim 1 wherein said means on said first extremity of said first control piece comprises:

a protuberant camming control stop on a vertical face of said first control piece which faces said seal and upon which a discharge cover travels and rests from which said seal depends.

3. The device of claim 2 wherein said means on said first extremity of said second control piece comprises:

a bifurcated terminal portion which engages said discharge cover.

4. The device of claim 3 wherein said first float means is threadedly connected to said second extremity by a tiny rod whereby the distance between said first float means and said second extremity can be varied by threading said tiny rod into said second extremity of said first control piece.

5. The device of claim 4 wherein said first extremities of said first and second control pieces each having declinations upwardly and towards said discharge cover.

* * * * *